US005946739A

United States Patent [19]

Descent

[11] Patent Number: 5,946,739

[45] Date of Patent: Sep. 7, 1999

[54] MIXING CHAMBER FOR USE IN A TOILET SANITIZING SYSTEM

[75] Inventor: Serge Jacques Descent, St. Petersburg, Fla.

[73] Assignee: Delan, Inc., St. Petersburg, Fla.

[21] Appl. No.: 09/121,982

[22] Filed: Jul. 24, 1998

[51] Int. Cl.[6] ..... E03D 9/02

[52] U.S. Cl. ..... 4/222; 4/233

[58] Field of Search ..... 4/222, 223, 224, 4/225.1, 226.1, 233

[56] References Cited

U.S. PATENT DOCUMENTS

| | | | |
|---|---|---|---|
| 761,021 | 5/1904 | Venners | 4/226.1 |
| 846,100 | 3/1907 | Estep | 4/226.1 X |
| 1,520,789 | 12/1924 | Weill . | |
| 3,290,698 | 12/1966 | Joyner et al. | 4/225.1 |
| 3,837,018 | 9/1974 | Haberle . | |
| 4,536,899 | 8/1985 | Schnyder . | |
| 4,734,942 | 4/1988 | Blanchard . | |
| 4,993,084 | 2/1991 | McCauley et al. | 4/224 |
| 5,119,517 | 6/1992 | Chang . | |
| 5,504,946 | 4/1996 | Keshiro . | |

FOREIGN PATENT DOCUMENTS

| | | |
|---|---|---|
| NR 52034 | 2/1912 | Germany . |

*Primary Examiner*—Charles E. Phillips
*Attorney, Agent, or Firm*—Larson & Larson, P.A.; James E. Larson

[57] ABSTRACT

A mixing chamber for use in a toilet sanitizing system consists of a cylindrical housing having an upper opening closed by a closure cap. The closure cap is removed to gain access to the internal chamber of the housing and is threaded over the upper opening to close the internal chamber. The internal chamber of the housing includes a spring to support a lower surface of a dispenser enclosing a block of germicide substance that is inserted into the internal chamber through the upper opening while the closure cap is removed. The internal chamber has three ports, an upper inlet port that enters the internal chamber tangentially, a middle outlet port exiting the chamber radially, and a lower outlet port radially exiting the chamber and located just above a lower wall of the chamber. The upper port is connected to a source of water, the middle port is connected to a toilet bowl, and the lower port is connected to the associated toilet seat. In operation, a block of germicide substance is placed within a dispenser in the internal chamber and wedged between the spring and lower portion of the closure cap. When the associated toilet is flushed, water is supplied through the upper port, flows tangentially over the dispenser and block of germicide substance, dissolving some of the block to create a sanitizing solution, which then flows into the lower portion of the internal chamber filling it and exiting from the middle port to the toilet bowl and from the lower port to the toilet seat under influence of a pump. When the inlet valve is closed, the pump is concurrently stopped and any sanitizing solution that subsides above the level of the middle port naturally drains to the toilet bowl.

13 Claims, 4 Drawing Sheets

MIXING CHAMBER FOR USE IN A TOILET SANITIZING SYSTEM

BACKGROUND OF THE INVENTION

The present invention relates to a mixing chamber for use in a toilet sanitizing system.

Applicant's co-pending U.S. patent application Ser. No. 08/931,929, filed Sep. 17, 1997, is directed to a self-sanitizing toilet seat cleaning apparatus that includes a schematically depicted reservoir intended to supply disinfectant to a toilet bowl and toilet seat. The present invention may be employed in Applicant's co-pending application as the reservoir.

SUMMARY OF THE INVENTION

The present invention relates to a mixing chamber for use in a toilet sanitizing system. The present invention includes the following interrelated objects, aspects and features:

(1) In a first aspect, the inventive mixing chamber preferably consists of a cylindrical housing having an upper opening with peripheral threads configured to receive the external threads of a closure cap. The closure cap is removed to gain access to the internal chamber of the housing and is threaded over the upper opening to close the internal chamber.

(2) The internal chamber of the housing includes a spring extending from the bottom of the chamber upwards to support at block of germicide substance within a dispenser that is inserted into the internal chamber through the upper opening while the closure cap is removed.

(3) The internal chamber has three ports, an upper port comprising an inlet that enters the internal chamber tangentially, a middle port exiting the chamber radially and located just below the bottom of the germicide dispenser and a lower port radially exiting the chamber and located just above a lower wall thereof.

(4) The upper port is fluidly connected to a source of water, the flow of which is suitably controlled by a refill valve. The middle port is fluidly connected to the bowl of the associated toilet by a suitable conduit, and the lower port is fluidly connected to the associated toilet seat through a suitable conduit. If desired, filters may be provided for either or both of the middle and lower ports.

(5) In operation, a block of germicide substance within a dispenser is placed in the internal chamber and supported between the spring and a cap seal. When the associated toilet is flushed, a valve is opened allowing water to be supplied through the upper port, which water flows tangentially into the internal chamber and over the block of germicide substance, whereupon some of the block slowly dissolves mixing germicide with the water, which then flows into the lower portion of the internal chamber filling the lower portion and beginning to exit from the middle port to the toilet bowl and from the lower port to the toilet seat under influence of a pump. When the inlet valve is closed stopping flow of water into the internal chamber, the pump is concurrently stopped and any water mixed with germicide that subsides above the level of the middle port naturally drains therefrom to the toilet bowl until such time as the level descends below the level of the middle port. In the preferred embodiment, the block of germicide substance has sufficient germicide to provide about 1500 flushes.

(6) A mounting collar is provided about the periphery of the cylindrical housing and is sized and configured to permit easy mounting of the mixing chamber using existing structures in a toilet.

Accordingly, it is a first object of the present invention to provide a mixing chamber for use in a toilet sanitizing system.

It is a further object of the present invention to provide such a mixing chamber with outlets designed to supply germicide mixed with water to the toilet seat and toilet bowl.

It is a still further object of the present invention to provide such a mixing chamber including a spring to support a block of germicide material.

It is a yet further object of the present invention to provide such a mixing chamber with an inlet that supplies water tangentially to the internal chamber thereof.

These and other objects, aspects and features of the present invention will be better understood from the following detailed description of the preferred embodiment when read in conjunction with the appended drawing figures.

SPECIFIC DESCRIPTION OF THE PREFERRED EMBODIMENT

Figure 1:
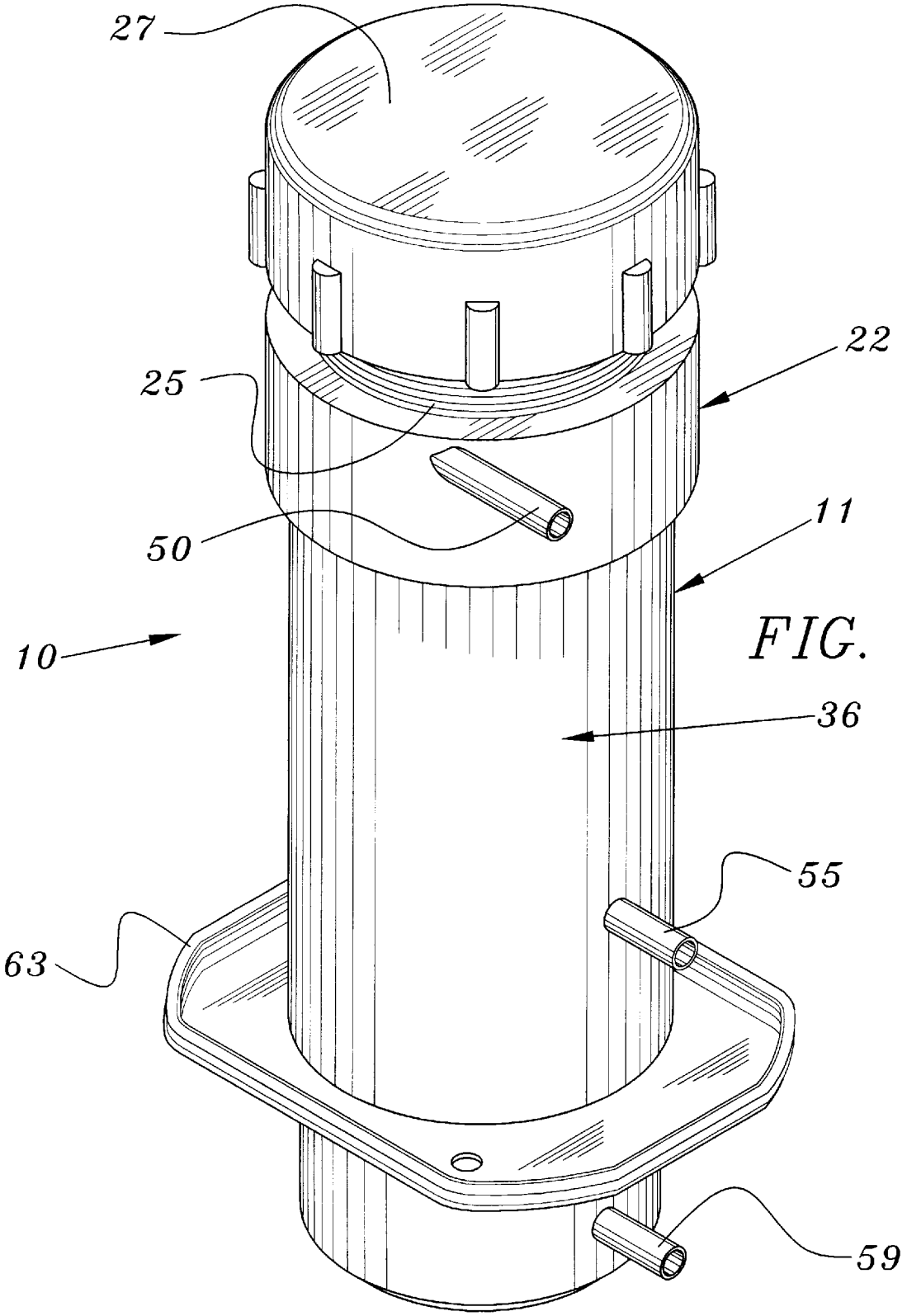
FIG. 1 shows a perspective view of the inventive mixing chamber.
Figure 2:
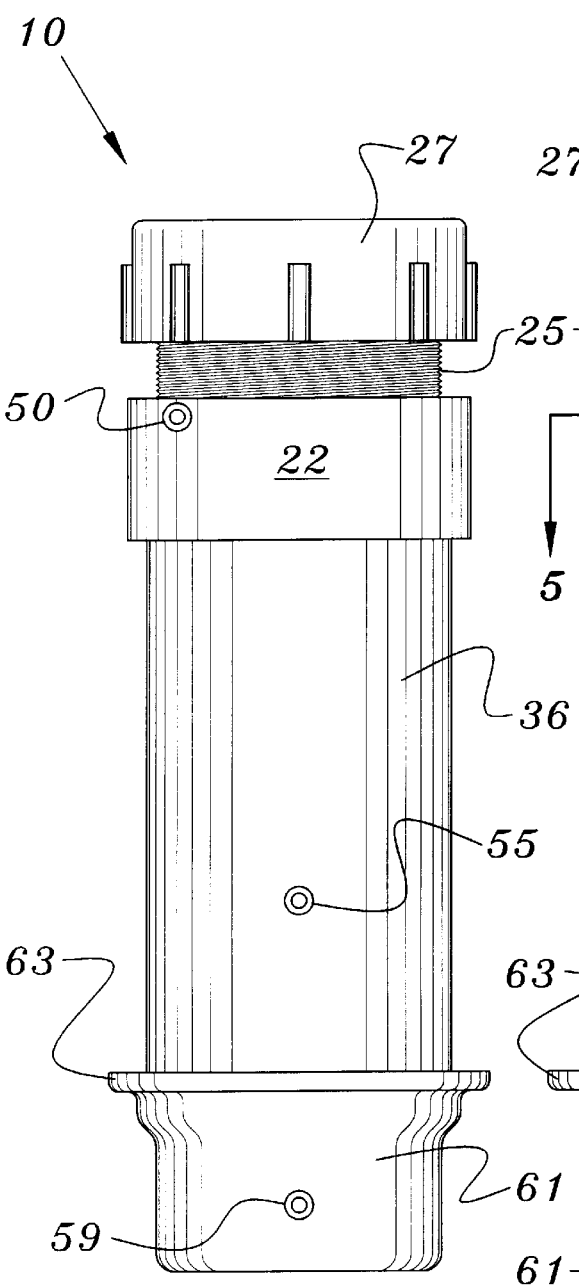
FIG. 2 shows a front view of the inventive mixing chamber.
Figure 3:
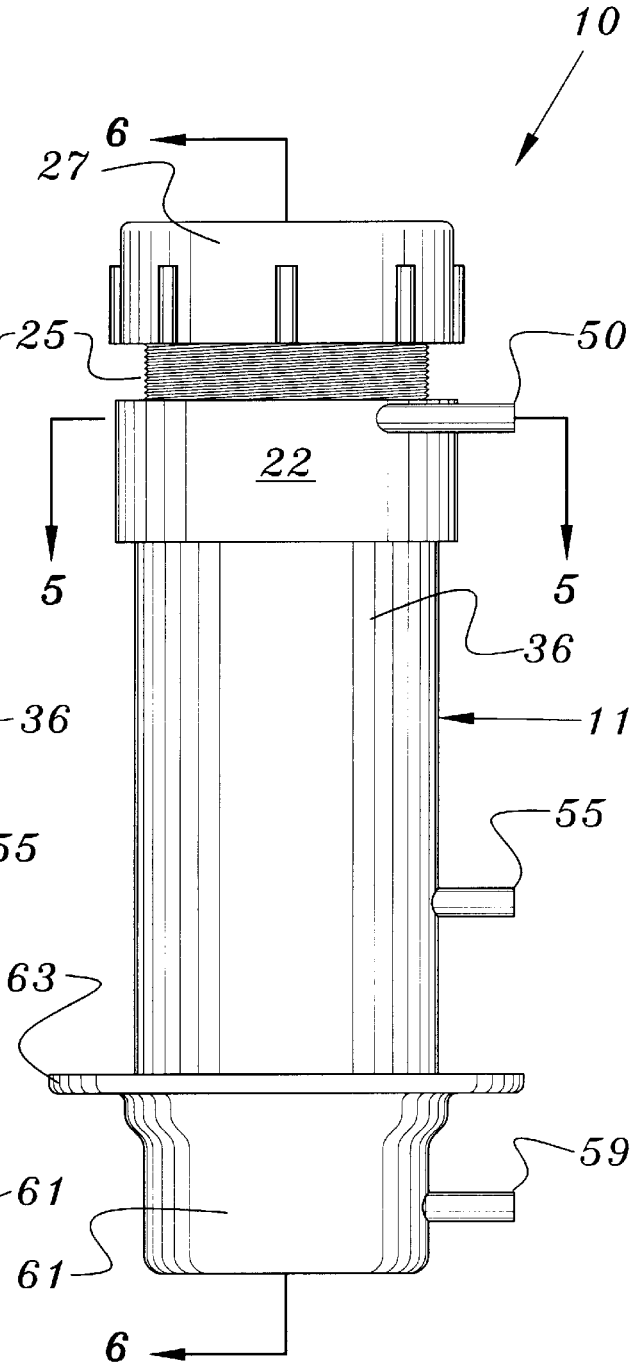
FIG. 3 shows a side view of the inventive mixing chamber.
Figure 4:
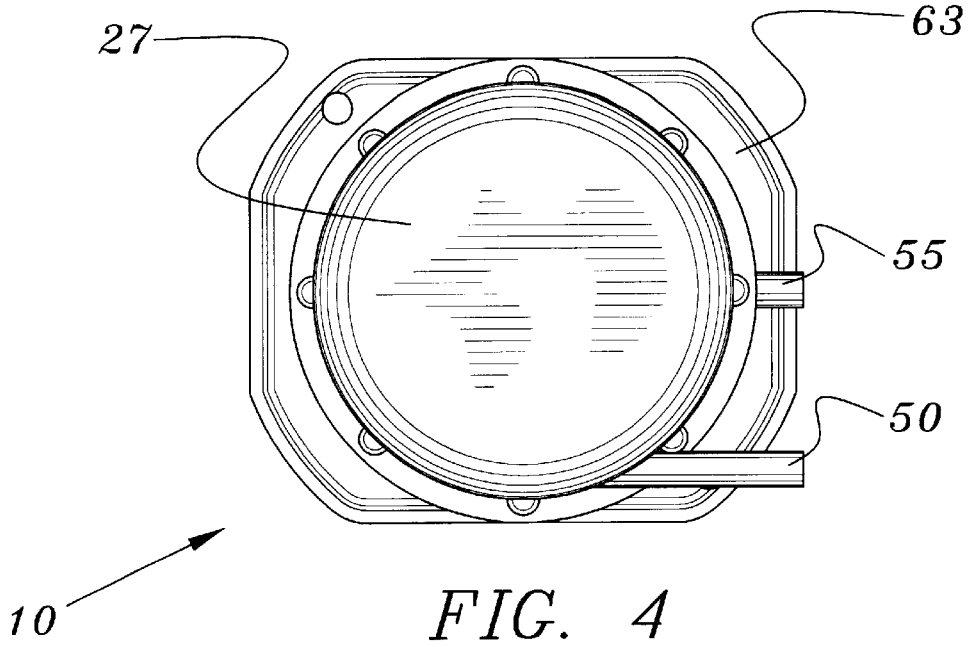
FIG. 4 shows a top view thereof.
Figure 5:
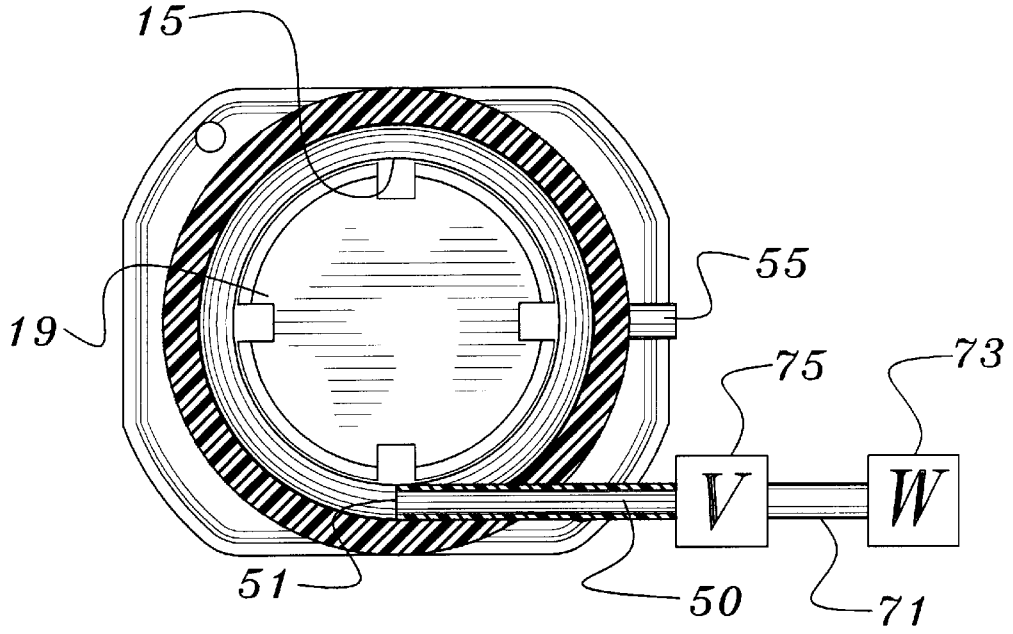
FIG. 5 shows a cross-sectional view along the line 5—5 of FIG. 3.
Figure 6:
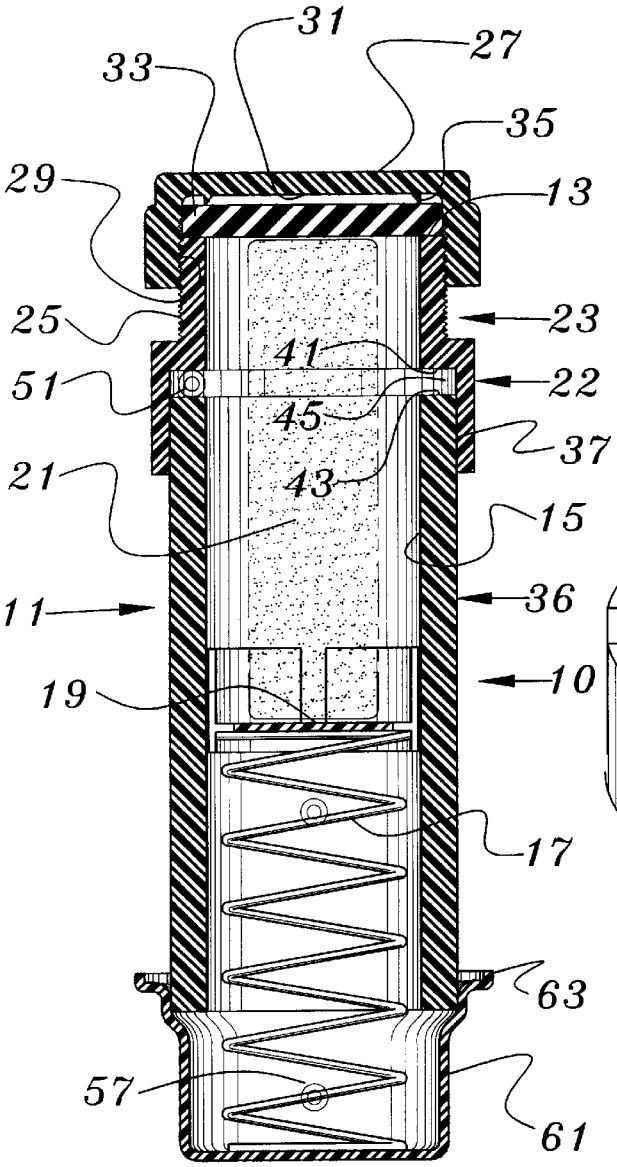
FIG. 6 shows a cross-sectional view along the line 6—6 of FIG. 3.
Figure 7:
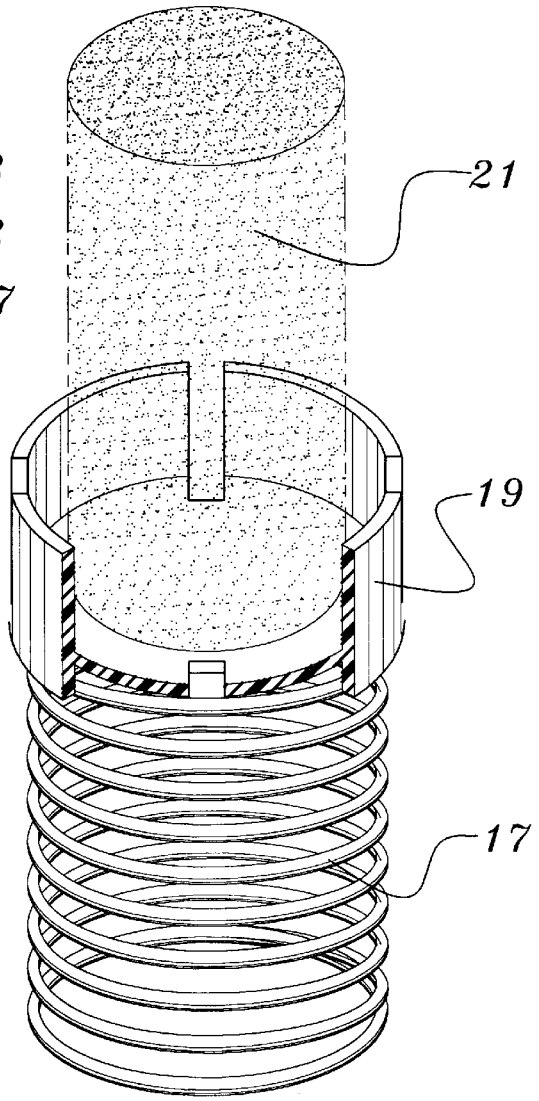
FIG. 7 shows a break-away view of the germicide dispenser supported by a resilient element.

With reference, first, to FIGS. 1–6, the present invention of the chemical dispenser is generally designated by the reference numeral 10 and is seen to include a cylindrical housing 11 having an upper opening 13 (FIG. 6) and an internal chamber 15 (FIG. 6). Within the internal chamber 15, a spring 17 is provided and is designed to retain a dispenser 19 containing a block 21 of germicidal substance shown in phantom in FIG. 6 in the position shown. The block 21 is preferably of a cylindrical configuration and dissolves, slowly, when water flows thereover.

The upper end 23 of the cylindrical housing 11 has external threads 25 configured to enmesh with internal threads 29 (FIG. 6) of a cap 27 that is threaded over the upper portion 23 of the housing 11 to seal the internal chamber 15. A rubber seal 33 is placed over the upper opening 13 of the housing 11 and the internal upper surface 31 of the cap 27 has a downwardly depending peripheral lip 35 that impinges into upper surfaces of the seal 33 to press the seal 33 into sealed position over the upper opening 13 of the housing 11. The dispenser 19 containing the germicide block 21 is wedged between the seal 33 and the spring 17.

As seen, in particular, in FIG. 6, the upper portion 23 of the housing 11 is formed of a separate component 22 mounted over a lower housing portion 36 with the interface 37 therebetween providing a surface contact therebetween that allows fixation through the use of a suitable adhesive.

As best seen in FIG. 6, the upper housing portion 22 includes a downwardly directed face 41 that is spaced from an upwardly directed face 43 of the lower housing portion 36 to define a small chamber 45 therebetween. Within the chamber 45, an inlet port 51 is defined at the end of a tube 50 that enters the chamber 45 tangentially as best seen in FIG. 5. In this way, water entering the internal chamber 15 enters tangentially and with a swirling action to best promote uniform mixing with the block 21. A middle port 53 enters the internal chamber 15 radially and is defined by the tube 55, best seen in FIGS. 1 and 3. A lower port 57 enters the chamber 15 radially and is defined by the end of the tube 59, best seen in FIGS. 1 and 3. The tube 59 extends through a cup-like member 61 mounted on the lower end of the housing portion 36 as best seen in FIG. 6. The member 61 has an upper collar 63 that is sized and configured to allow easy insertion into an existing sanitizing system located within an existing standard toilet.

In the preferred mode of operation of the present invention, the tube 50 is connected to a source 71 (FIG. 5) of water via a conduit 73 with a valve 75 interposed between the conduit 73 and the tube 50. The valve 75 is controlled in a suitable manner in conjunction with the operation of the flushing system of the associated toilet.

A block 21 of germicidal substance within a dispenser 19 is placed within the internal chamber 15 in the configuration shown in FIG. 6. The tube 55 is fluidly connected to the toilet bowl of the associated toilet while the tube 59 is fluidly connected to the toilet seat of the associated toilet. The interconnection between the tube 59 and the toilet seat includes interposition of a pump (not shown) that, when activated, pumps water mixed with germicide (a mixture comprising a sanitizing solution) to the seat and, wherein, such flow stops when the pump is deactivated.

When the flush cycle begins, the valve 75 is opened allowing water to flow through the tube 50 and into the internal chamber 15. The pump (not shown) associated with the tube 59 pumps water mixed with germicide out the tube 59 and to the toilet seat whereupon the sanitizing solution is sprayed on the toilet seat. Concurrently, some sanitizing solution flows from the tube 55 to the bowl of the associated toilet. In a prescribed manner, after a period of time, for example, 8 seconds, has elapsed, the pump (not shown) is stopped, thereby stopping flow of water mixed with germicide from the tube 59. With particular reference to FIG. 6, any fluid remaining within the chamber 15 above the level of the port 53 flows therefrom and to the bowl via the tube 55 to sanitize the bowl. Such fluid flow stops when the level of fluid within the chamber 15 drops below the level of the port 53.

In the preferred embodiment of the present invention, the housing 11 and cap 27 are made of suitable molded plastic materials while the seal 33 is made of a suitable rubber compound. The tubes 50, 55 and 59 are also made of a suitable plastic material. The spring 17 is about three and one-half inches long, has a diameter about one inch and is preferably made of stainless steel.

Accordingly, an invention has been disclosed in terms of a preferred embodiment thereof which fulfills each and every one of the objects of the invention as set forth hereinabove and provides a new and useful mixing chamber for use in a toilet sanitizing system of great novelty and utility.

Of course, various changes, modifications and alterations in the teachings of the present invention may be contemplated by those skilled in the art without departing from the intended spirit and scope thereof.

As such, it is intended that the present invention only be limited by the terms of the appended claims.

I claim:

1. A mixing chamber for use in a toilet sanitizing system, comprising:

a) a generally cylindrical housing with an internal chamber having an upper opening closed by a removable cap;

b) support means within said internal chamber for supporting a block of germicidal material;

c) an upper inlet port entering said internal chamber tangentially and connecting said internal chamber with a source of water;

d) a middle outlet port connecting said internal chamber with a toilet bowl;

e) a lower outlet port connecting said internal chamber, with a toilet seat;

f) whereby water entering said internal chamber via said inlet port flows over said block, slowly dissolving said block and forming a sanitizing solution that flows out said middle outlet port and said lower outlet port.

2. The mixing chamber of claim 1, wherein said block is generally cylindrical and enclosed partially within a dispenser wedged between the cap and a spring.

3. The mixing chamber of claim 1, wherein said outlet ports exit said internal chamber radially.

4. The mixing chamber of claim 1, wherein said cap is threadably received over said upper opening.

5. The mixing chamber of claim 1, wherein said support means comprises a spring resting on a bottom of the mixing chamber at one end and exerting pressure on said block at a second end.

6. The mixing chamber of claim 1, further including a peripheral collar on said housing for mounting said housing in a toilet.

7. The mixing chamber of claim 6, wherein said collar is formed on a cup-like member closing a lower opening of said housing.

8. The mixing chamber of claim 7, wherein said lower outlet port extends through said member.

9. A mixing chamber for use in a toilet sanitizing system, comprising:

a) a cylindrical housing with an internal chamber having an upper opening closed by a removable threaded cap;

b) a resilient member within said internal chamber for supporting a block of germicidal material contained within a dispenser, the dispenser wedged between the resilient member and the removable threaded cap;

c) an upper inlet port connecting said internal chamber with a source of water and entering said internal chamber tangentially;

d) a middle outlet port connecting said internal chamber with a toilet bowl and radially exiting said internal chamber;

e) a lower outlet port connecting said internal chamber with a toilet seat and exiting said internal chamber radially;

f) whereby water entering said internal chamber via said inlet port flows over said block, slowly dissolving said block and forming a sanitizing solution that flows out said middle outlet port and said lower outlet port.

10. The mixing chamber of claim 9, wherein said block is generally cylindrical within a generally cylindrical dispenser.

11. The mixing chamber of claim 9, further including a peripheral collar on said housing for mounting said housing in a toilet.

12. The mixing chamber of claim 11, wherein said collar is formed on a cup-like member closing a lower opening of said housing.

13. The mixing chamber of claim 12, wherein said lower outlet port extends through said member.

* * * * *